US008955434B2

(12) United States Patent
Kanungo et al.

(10) Patent No.: US 8,955,434 B2
(45) Date of Patent: Feb. 17, 2015

(54) APPARATUS FOR DIGITAL FLEXOGRAPHIC PRINTING

(75) Inventors: Mandakini Kanungo, Webster, NY (US); Kock-Yee Law, Penfield, NY (US); George Cunha Cardoso, Webster, NY (US); Jing Zhou, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 342 days.

(21) Appl. No.: 13/274,659

(22) Filed: Oct. 17, 2011

(65) Prior Publication Data

US 2013/0092038 A1 Apr. 18, 2013

(51) Int. Cl.
*B41F 5/24* (2006.01)
*B41M 5/20* (2006.01)
*B41M 1/04* (2006.01)

(52) U.S. Cl.
CPC ... *B41M 5/20* (2013.01); *B41M 1/04* (2013.01)
USPC ..... 101/216; 101/350.1

(58) Field of Classification Search
USPC ..... 101/153
See application file for complete search history.

(56) References Cited

U.S. PATENT DOCUMENTS

| | | | | |
|---|---|---|---|---|
| 3,084,043 | A * | 4/1963 | Gundlach | 430/103 |
| 3,973,955 | A * | 8/1976 | Ohno et al. | 430/103 |
| 4,202,620 | A * | 5/1980 | Klavan et al. | 399/240 |
| 4,202,913 | A * | 5/1980 | Klavan et al. | 430/118.4 |
| 4,982,692 | A * | 1/1991 | Uematsu | 399/239 |
| 5,640,189 | A * | 6/1997 | Ohno et al. | 347/141 |
| 6,100,909 | A * | 8/2000 | Haas et al. | 347/141 |
| 6,578,478 | B2 * | 6/2003 | Doppler | 101/153 |
| 2005/0233252 | A1 * | 10/2005 | Dantas | 430/306 |
| 2006/0103694 | A1 * | 5/2006 | Nguyen | 347/47 |
| 2011/0039196 | A1 | 2/2011 | Kanungo et al. | |
| 2011/0039201 | A1 | 2/2011 | Law et al. | |

OTHER PUBLICATIONS

U.S. Appl. No. 12/869,605, filed Aug. 26, 2010; Title: Direct Digital Marking Systems; Inventors: Kock-Yee Law et al.

* cited by examiner

*Primary Examiner* — Jill Culler
(74) *Attorney, Agent, or Firm* — Fay Sharpe LLP

(57) ABSTRACT

A digital flexography system includes an imaging member with a charge generating layer formed from an array of addressable pixels and a charge transport layer thereon. Ink is delivered to the imaging member using a simple rough donor roll, rather than an anilox roll. Instead of controlling the amount of ink delivered using the anilox roll, the amount of ink is controlled by the pixels on the imaging member.

18 Claims, 7 Drawing Sheets

APPARATUS FOR DIGITAL FLEXOGRAPHIC PRINTING

CROSS-REFERENCE TO RELATED APPLICATIONS

This application is related to U.S. patent application Ser. No. 12/539,397, filed Aug. 11, 2009; U.S. patent application Ser. No. 12/539,557, filed Aug. 11, 2009; and U.S. patent application Ser. No. 869,605, filed Aug. 26, 2010. The disclosures of these three applications are hereby fully incorporated by reference in their entirety.

BACKGROUND

Conventional flexography is a printing process which uses a flexible relief plate instead of a rigid relief plate. Flexography is commonly used in the packaging industry and in label printing because of excellent print quality, larger substrate latitude, efficiency, large color gamut, and low ink costs. Flexography has a high engine unit manufacturing cost (UMC) and a relatively low run cost. However, run costs increase for short runs (less than ~2000 prints) or with variable data due to the need to make a new image plate for each run.

For short runs, flexography competes with two other commonly used digital printing platforms, xerography and solid inkjet printing. Xerographic printing involves multiple steps including charging of the photoreceptor and forming a latent image on the photoreceptor; transferring and fusing the developed image onto a substrate medium (such as paper); and erasing and cleaning the photoreceptor. Although xerographic printing is a mature technology, the engine UMC is still high, as is the run cost.

Solid inkjet printing (SIJ) is another printing technology which is now serving the office color market and is working towards the production color market. SIJ uses solid ink sticks instead of the fluid ink or toner powder usually used in xerography printers. The ink stick is melted and is used to jet the image on a substrate, similar to conventional inkjet printing. Challenges to mastering SIJ include high unit UMC and high run cost.

It would be desirable to develop digital flexographic printing systems and methods which reduce engine UMC and run cost.

BRIEF DESCRIPTION

The present application discloses, in various embodiments, digital marking systems. The systems include a nano-enabled imaging member and a development subsystem.

Disclosed in some embodiments is a flexographic printing system comprising a nano-enabled imaging member and a development subsystem. The nano-enabled imaging member comprises an array of hole-injecting pixels and a charge transport layer disposed over the array of hole-injecting pixels. Each pixel is electrically isolated and individually addressable. The development subsystem includes a rough ink donor roll and an ink supply.

The nano-enabled imaging member may further comprise an array of thin film transistors between a substrate and the array of hole-injecting pixels. Each thin film transistor is connected to one pixel of the array of hole-injecting pixels.

Each pixel may comprise a nano-carbon material. The nano-carbon material may be a single-wall carbon nanotube, a double-wall carbon nanotube, a multi-wall carbon nanotube, graphene, and mixtures thereof.

In specific embodiments, the nano-carbon material is a carbon nanotube or graphene.

Alternatively, each pixel may comprise a conjugated polymer, such as PEDOT:PSS. Other conjugated polymers include poly(3,4-ethylenedioxythiophene) (PEDOT), alkyl substituted ethylenedioxythiophene, phenyl substituted ethylenedioxythiophene, dimethyl substituted polypropylenedioxythiophene, cyanobiphenyl substituted 3,4-ethylenedioxythiopene, teradecyl substituted PEDOT, dibenzyl substituted PEDOT, an ionic group substituted PEDOT, a dendron substituted PEDOT, and mixtures thereof.

The charge transport layer may comprise a charge transport molecule dispersed in a binder polymer. The charge transport molecule may be a pyrazoline, diamine, arylamine, hydrazone, oxadiazole, or stilbene. The binder polymer may be a polycarbonate, polyarylate, polystyrene, acrylate polymer, vinyl polymer, cellulose polymer, polyester, polysiloxane, polyimide, polyurethane, polycycloolefin, polysulfone, or epoxy. In specific embodiments, the charge transport layer comprises N,N'-diphenyl-N,N'-bis(3-methylphenyl)-(1,1'-biphenyl)-4.4'-diamine.

The rough ink donor roll may have a surface roughness of from about 0.1 μm to about 50 μm. A gap between the nano-enabled imaging member and the rough ink donor roll may be from about 1 μm to about 50 μm wide.

Disclosed in some embodiments is a flexographic printing system comprising a nano-enabled imaging member and a development subsystem. The nano-enabled imaging member comprises a substrate, an array of hole-injecting pixels, and a charge transport layer disposed over the array of hole-injecting pixels. Each pixel is electrically isolated and individually addressable. Each pixel is also formed from a nano-carbon material or a conjugated polymer. The development subsystem includes a rough ink donor roll and an ink supply.

These and other non-limiting characteristics of the disclosure are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
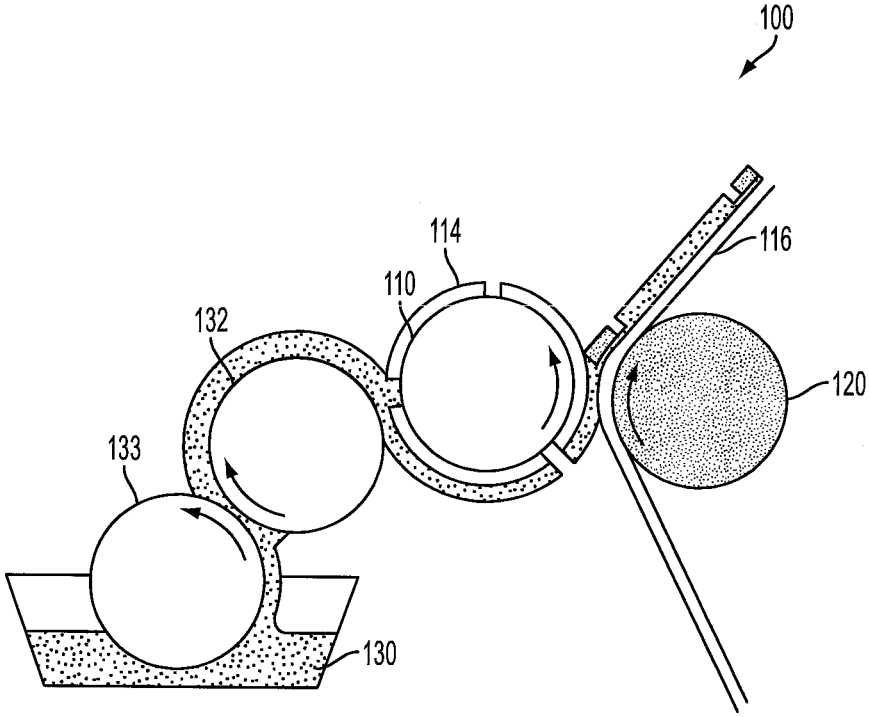
FIG. 1 PRIOR ART
FIG. 1 illustrates a conventional method of flexographic printing.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The modifier "about" used in connection with a quantity is inclusive of the stated value and has the meaning dictated by the context (for example, it includes at least the degree of error associated with the measurement of the particular quantity). When used in the context of a range, the modifier "about" should also be considered as disclosing the range defined by the absolute values of the two endpoints. For example, the range of "from about 2 to about 10" also discloses the range "from 2 to 10."

The term "comprising" is used herein as requiring the presence of the named component and allowing the presence of other components. The term "comprising" should be construed to include the term "consisting of", which allows the presence of only the named component, along with any impurities that might result from the manufacture of the named component.

The term "on" or "upon" the substrate refers to the various layers and components with reference to the substrate as being the bottom or support for all of the layers and components which are on top of it. In other words, all of the layers or components are on the substrate, even though they do not all directly contact the substrate. For example, both the charge generating layer and the charge transport layer are on the substrate, even though one layer is closer to the substrate than the other layer.

FIG. 1 is a conventional flexographic system 100. Conventional flexography is a printing process which uses a flexible relief plate instead of rigid relief plate like letterpress. The flexible plate contains raised image areas and lowered non-image areas. Only the raised image areas of the plate come in contact with the substrate during printing. Flexographic plates are made up of flexible materials such as plastic, rubber or UV sensitive polymer so that the plate can be attached to a roller or cylinder for ink application. In a typical flexo printing sequence, the substrate is fed into the press from a roll (not shown). The flexographic printing system employs a plate cylinder supporting the flexible relief plate, a metering cylinder known as the anilox roll that applies ink to the plate, and an ink pan which provides the ink. Some flexo systems use a third roller known as fountain roller and in some cases a doctor blade is used for improved ink distribution. Here, the ink pan 130 supplies ink to a fountain roll 133. The fountain roll supplies ink to the anilox roll 132, which meters the amount of ink applied to the plate 114 located upon plate cylinder 110. An impression cylinder 120 is used to move the substrate 116 against the plate cylinder 110, where the ink is transferred to the substrate. FIG. 1 illustrates flexographic printing for a single color. For color printing, the substrate is pulled through a series of similar stations or print units. Each print unit prints a single color onto the substrate.

Figure 2:
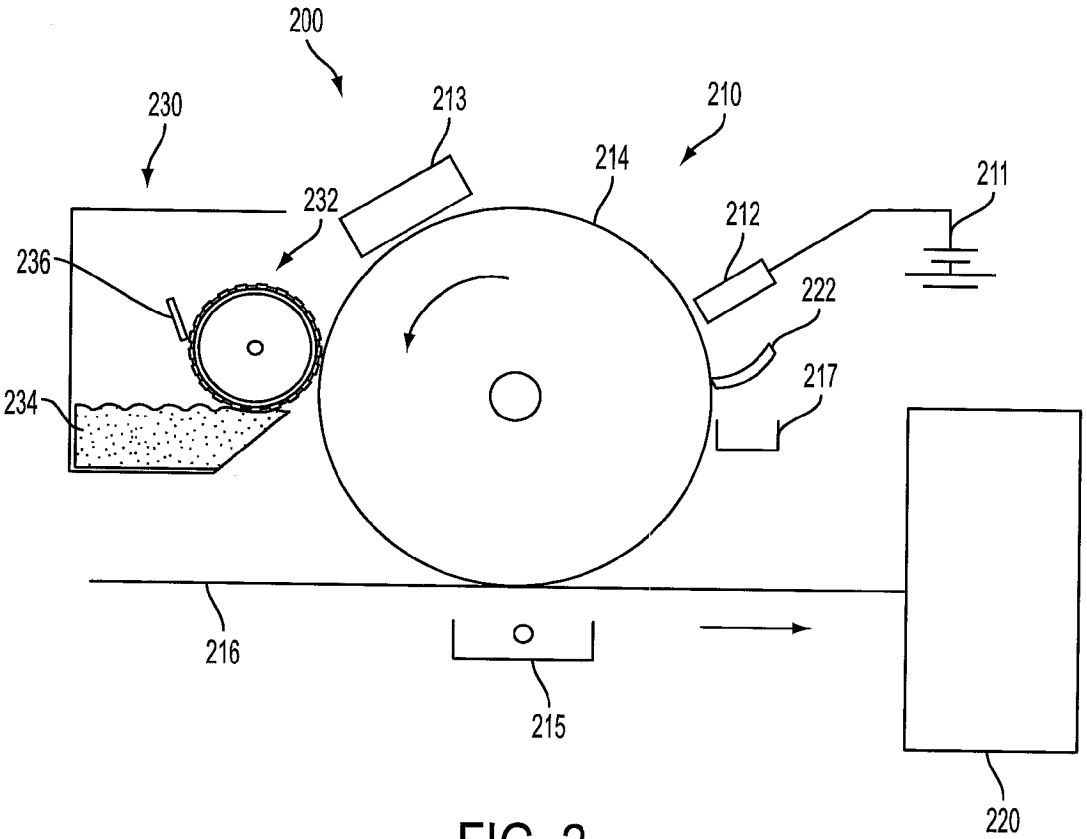
FIG. 2 PRIOR ART
FIG. 2 is a schematic diagram illustrating a digital flexographic printing system using a photoconductor.

FIG. 2 is another previous approach. This system 200 digitizes the printing process by using electrostatic printing of flexo inks via electrostatic latent images created on a photoconductor (e.g. amorphous silicon) using a laser/ROS and charger. An electrostatic latent image is created upon a photosensitive imaging member, the latent image is subsequently developed by the application of ink, and the developed image is transferred to a receiving medium such as paper. As shown here, going counter-clockwise, photoconducting imaging member 210 receives a substantially uniform electrostatic charge on its surface 214 via charging station 212 (such as a scorotron) to which a voltage has been supplied from power supply 211. The photoconductor is then imagewise exposed to light at imaging station 213 from an optical system or an image input apparatus, such as a laser, light emitting diode, or other raster output scanner (ROS). This light exposure forms an electrostatic latent image thereon by selectively altering the substantially uniform electrostatic charge. The electrostatic latent image is then developed at developing station 230 by contacting the electrostatic latent image with flexo ink. This will be followed by the transfer of the ink image onto a receiving medium 216, such as paper, rheologically or electrostatically, for example by pressure, heat and/or UV at transfer station 215. Photoconducting imaging member 210, after transfer, advances to cleaning station 217, wherein any remaining ink is cleaned therefrom, for example by use of a cleaning blade 222, brush, or other cleaning apparatus. A fixing station 220 fixes the transferred image to the receiving medium.

Focusing on the developing station 230, an anilox roll 232 is used to transfer ink from an ink supply 234 to the surface 214 of the photoconductor. An anilox roll is a hard cylinder whose surface contains millions of very fine cells. The anilox roll is usually constructed of a steel or aluminum core which is coated by an industrial ceramic. An anilox roll is often specified by its line screen, which is the number of cells per linear inch. The line screen often ranges from between about 250 to about 1500. The anilox roll is either partially submersed in the ink supply fountain, or comes into contact with a metering roller. As a result, a thick layer of typically viscous ink is deposited on the roll. A doctor blade 236 is used to scrape excess ink from the anilox roll, leaving just the measured amount of ink in the cells. The roll then rotates to contact the photoreceptor 210, which receives the ink from the cells for transfer to the receiving medium 216.

The use of an charging system in charging station 212, laser/ROS in imaging station 213 and an anilox roll can increase the costs of the overall printing system. The laser/ROS and the charger adds substantial cost to the UMC. In addition, an anilox roll is much more expensive compared to a rough roll. The term "rough" is used here to indicate that the surface of the roll is not scored or processed to form cells on the surface. Rather than carrying a specified amount of ink as with an anilox roll, the surface of a rough roll simply carries an ink layer to be metered by a doctor blade.

The present disclosure thus relates to a digital marking system that electrostatically prints flexographic ink using a lower-cost printing unit. In this regard, flexographic inks differ from toner inks in certain respects. First, flexo inks have a higher pigment concentration compared to toner inks and thus can be printed in a thinner layer compared to toner inks. For example, the pigment concentration of a flexo ink is usually in the range of 15 to 35 wt % of the ink, whereas the pigment concentration for a toner ink is usually in the range of 5 to 10 wt % of the ink. Second, the binders used in flexo inks are an order of magnitude cheaper than those used in toner inks. Finally, flexo inks have a larger color gamut that includes for example metallic inks and pearlescent ink. Flexo inks can be used, for example, for decorative printing, which is difficult to do with toner inks.

In the digital marking system of the present disclosure, the imaging drum includes a nano-enabled imaging member with a layer of individually addressable pixels. The pixels can be used to control the electrostatic latent image maintained on the imaging member. The imaging member creates the digital latent image in situ by selective activation of pixels, as opposed to the conventional case where a photoreceptor is uniformly charged and then imagewise discharged, thus reducing the number of components and steps in the process. In addition, an anilox roll does not need to be used to meter the ink being applied to the imaging drum. A simple rough ink donor roll can be used instead. The ink donor roll can be made of aluminum, steel, ceramic, or an appropriate plastic material.

Figure 3:
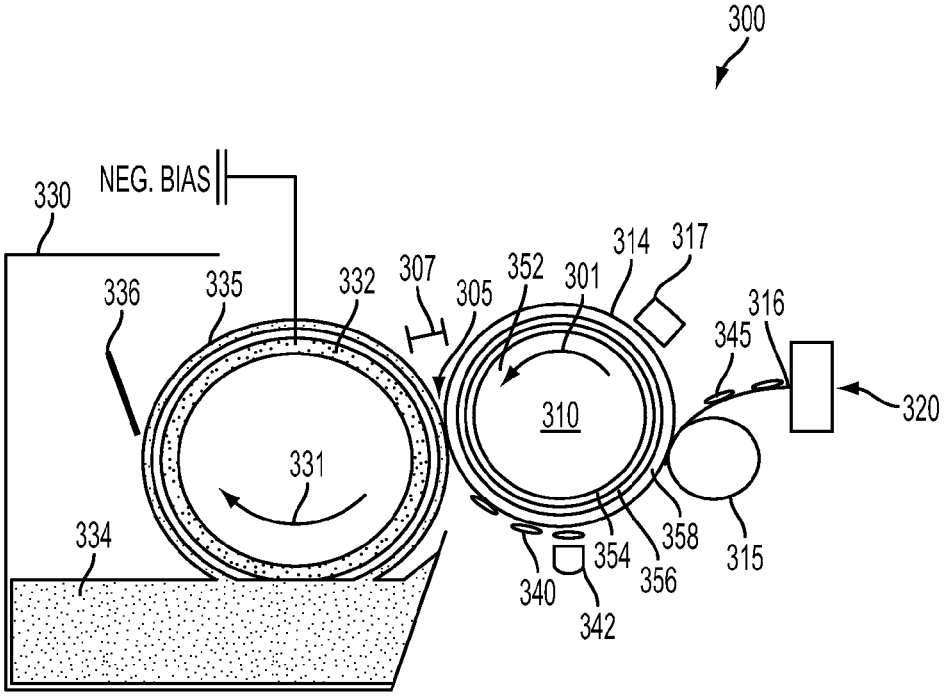
FIG. 3 is a schematic diagram illustrating a digital flexographic printing system of the present disclosure.

FIG. 3 illustrates an exemplary digital flexographic printing system 300 of the present disclosure. The digital flexographic printing system 300 includes a nano-enabled imaging member 310, shown here as a drum, with reference numeral 301 indicating the direction of rotation. The imaging member 310 carries an electrostatic latent image on its surface 314 which is generated by selective activation of pixels. As described further herein, the imaging member may include a substrate 352, a backplane 354 containing thin film transistor (TFT) arrays, a charge injection layer 356, and a charge transport layer 358. The digital flexographic printing system 300 also includes a development subsystem 330 to provide ink to the imaging member 310 and develop the electrostatic latent image; this developed image is indicated with reference numeral 340. An optional curing source 342 may be present to partially cure or tack the developed image 340; this curing source may be, for example, a LED light source for UV curable inks. The developed image is then transferred to a receiving medium 316, such as paper, at transfer station 315. The transferred image is indicated here with reference numeral 345. Any remaining ink on the imaging member 310 is then removed at cleaning station 317. A fixing station 320 then fixes the developed image to the receiving substrate or medium. Depending on the ink used, the developed image can be fixed on the receiving medium 316, for example, by heat, pressure, and/or UV radiation. In contrast to the system of FIG. 2, the digital flexographic printing system 300 does not include an imaging station or a charging station, so the cost for these stations is not incurred.

The development subsystem 330 includes an ink donor roll 332, with reference numeral 331 indicating the direction of rotation. The ink donor roll 332 rotates in the direction opposite that of the imaging member 310, i.e. if the nano-enabled imaging member 310 rotates counter-clockwise, then the ink donor roll 332 rotates clockwise. As will be discussed later, the donor roll 332 can be a simple rough donor roll, and does not need to be an anilox roll. The ink donor roll 332 pulls ink from an ink reservoir 334 that acts as an ink supply, forming an ink layer 335 on the donor roll. A doctor blade 336 is used to regulate the thickness of the ink layer 335 on the ink donor roll 332. The ink donor roll 332 may in embodiments be negatively biased. It should also be noted that the ink donor roll 332 directly applies ink from the ink supply 334 to the imaging member 310, without the need for an intermediate fountain roll as in FIG. 1.

Figure 4:
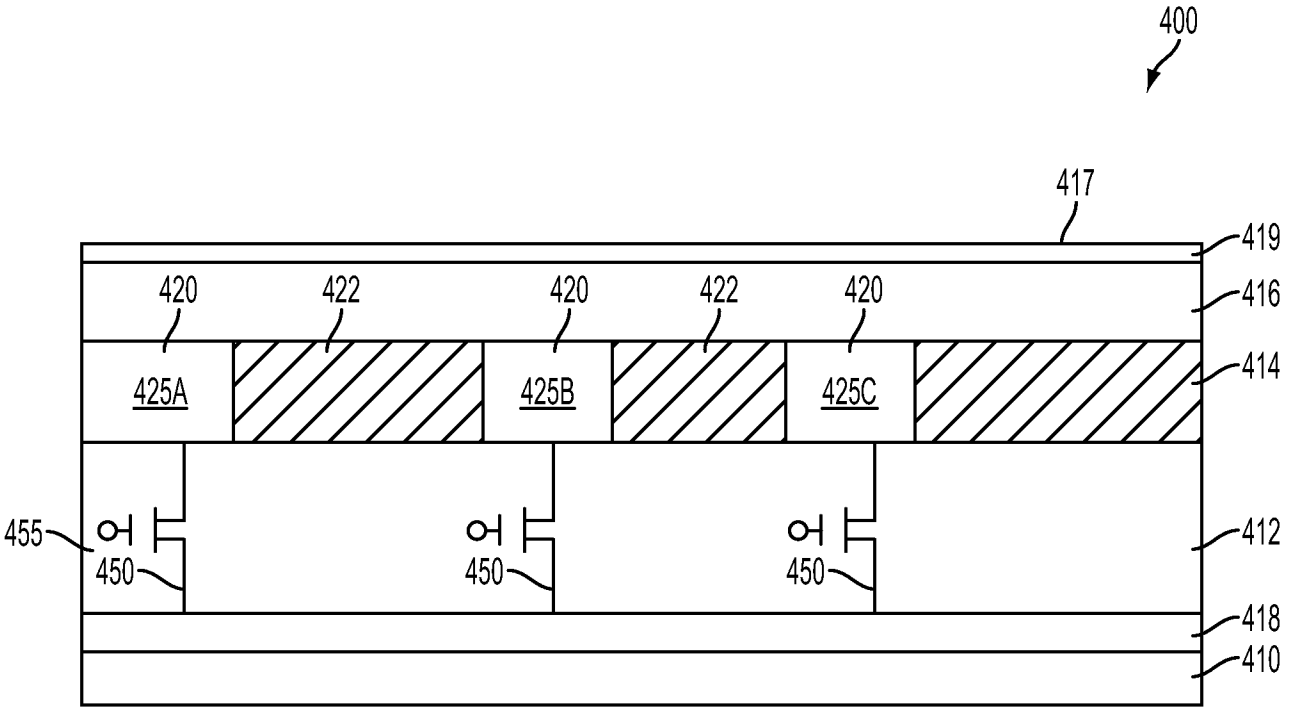
FIG. 4 is a cross sectional view of an exemplary nano-enabled imaging member of the present disclosure.

FIG. 4 is a cross-sectional view showing the components of the nano-enabled imaging member. The imaging member 400 includes a substrate 410. A hole injecting layer 414 is disposed upon the substrate. The hole injecting layer includes an array 420 of hole-injecting pixels 425 is disposed upon the substrate 410. Each pixel 425 of the array is electrically isolated and is individually addressable. As seen here, for example, insulating material 422 is present around each pixel to isolate the pixel from its neighbors. An active matrix backplane 412 containing TFT arrays is located between the substrate 410 and the hole injection layer 414. The active matrix backplane includes an array 450 of thin film transistors 455. Each thin film transistor 455 can be coupled to a single (i.e. one) pixel 425 in the array 420 in the hole injecting layer 414. A charge transport layer 416 is disposed over the hole injecting layer 412. The charge transport layer transports holes provided by the pixels 425 to the surface 417 of the imaging member 400. The surface 417 of FIG. 4 corresponds to the surface 314 of FIG. 3. An optional adhesion layer 418 can be located between the substrate 410 and the hole injection layer 414 if desired. An optional ink resistant protective layer 419 may also be placed over the charge transport layer 416. In such embodiments, please note the surface 417 of the imaging member is then provided by the protective layer, not the charge transport layer.

As used herein, the terms "hole-injecting pixel" and "array of hole-injecting pixels" are used interchangeably with the terms "pixel" and "array of pixels". The phrase "individually addressable" as used herein means that each pixel of an array of hole-injecting pixels can be identified and manipulated independently from its neighboring or surrounding pixel(s). For example, referring to FIG. 4, each pixel 325A, 425B, or 425C can be individually turned on or off independently from its neighboring or surrounding pixels. However in some embodiments, instead of addressing the pixels 425A-C individually, a group of pixels, e.g., two or more pixels 425A-B can be selected and addressed together, i.e. the group of pixels 425A-B can be turned on or off together independently from the other pixels 425C or other groups of pixels (not illustrated).

Each pixel 425 of the array 420 is made from a patternable material. In embodiments, each pixel comprises a nano-carbon material or an organic conjugated polymer. These materials can inject holes into the charge transport layer under the influence of an electric field, and those holes can be used to generate an electrostatic latent image. Another advantage of using the nano-carbon material and the organic conjugated polymer as the hole injection material is that they can be easily patterned by various fabrication techniques such as, for example, photolithography, inkjet printing, screen printing, transfer printing, and the like. In certain embodiments, the surface resistivity of the pixel containing the nano-carbon material and/or organic conjugated polymer can be from about 10 ohm/sq. to about 10,000 ohm/sq. or from about 10 ohm/sq. to about 5,000 ohm/sq., or from about 100 ohm/sq. to about 2,500 ohm/sq.

As used herein, the phrase "nano-carbon material" refers to a carbon-containing material having at least one dimension on the order of nanometers, for example, less than about 1000 nm. In embodiments, the nano-carbon material is a carbon nanotube. This includes single-wall carbon nanotubes (SWNT), double-wall carbon nanotubes (DWNT), and multi-wall carbon nanotubes (MWNT); and functionalized carbon nanotubes. A multi-wall carbon nanotube is composed of at least three cylindrical carbon nanotubes having different diameters, which are formed concentrically around each other. The carbon nanotubes can have any suitable length and diameter. The nano-carbon material could also be graphene or a functionalized graphene. Graphene is a single planar sheet of $sp^2$-hybridized bonded carbon atoms that are densely packed in a honeycomb crystal lattice and is exactly one atom in thickness with each atom being a surface atom. Also contemplated is a mixture of graphene and carbon nanotubes.

The carbon nanotubes, as synthesized and after purification, can be a mixture of carbon nanotubes structurally with respect to number of walls, diameter, length, chirality, and/or defect rate. For example, chirality may dictate whether the carbon nanotube is metallic or semiconductive. Carbon nanotubes are naturally a mixture of semiconductive nanotubes and metallic nanotubes, where the metallic nanotubes are only 33% by weight of the mixture. The carbon nanotubes can have a diameter ranging from about 0.1 nm to about 100 nm, or from about 0.5 nm to about 50 nm, or from about 1.0 nm to about 10 nm. The carbon nanotubes can have a length ranging from about 10 nm to about 5 mm, or from about 200 nm to about 10 μm, or from about 500 nm to about 1000 nm. In certain embodiments, the concentration of carbon nanotubes in the pixel can be from about 0.5 weight % to about 99 weight %, or from about 50 weight % to about 99 weight %, or from about 90 weight % to about 99 weight % of the pixel. The carbon nanotubes may be mixed with a binder polymer to form the pixel. Suitable binder polymers are known to those of ordinary skill in the art.

In various embodiments, the pixel can be coated from an aqueous dispersion or an alcohol dispersion of carbon nanotubes wherein the carbon nanotubes can be stabilized by a surfactant, DNA, or a polymeric material. In other embodiments, the pixel can include a carbon nanotube composite, such as a carbon nanotube polymer composite or a carbon nanotube filled resin.

When the pixel is made from an organic conjugated polymer, any suitable charge injecting polymer may be used. In various embodiments, the conjugated polymer is based on ethylenedioxythiophene (EDOT) or its derivatives. Such conjugated polymers can include, but are not limited to, poly(3,4-ethylenedioxythiophene) (PEDOT); alkyl substituted EDOT; phenyl substituted EDOT; dimethyl substituted polypropylenedioxythiophene, cyanobiphenyl substituted EDOT; teradecyl substituted PEDOT; dibenzyl substituted PEDOT; an ionic group substituted PEDOT such as sulfonate substituted PEDOT; a dendron substituted PEDOT such as dendronized poly(para-phenylene); and mixtures thereof. In specific embodiments, the organic conjugated polymer is a complex of PEDOT and polystyrene sulfonic acid (PSS). The molecular structure of the PEDOT:PSS complex can be shown as the following Structure (A):

Structure (A)

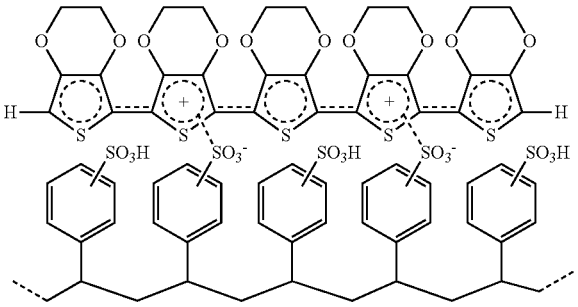

The PEDOT:PSS complex can be obtained through the polymerization of EDOT in the presence of the template polymer PSS. The conductivity of the PEDOT:PSS complex can be controlled, e.g. enhanced, by adding compounds with two or more polar groups, such as ethylene glycol, into an aqueous solution of PEDOT:PSS. As discussed in the thesis of Alexander M. Nardes, entitled "On the Conductivity of PEDOT:PSS Thin Films," 2007, Chapter 2, Eindhoven University of Technology, which is hereby incorporated by reference in its entirety, such an additive can induce conformational changes in the PEDOT chains of the PEDOT:PSS complex. The conductivity of PEDOT can also be adjusted during the oxidation step. Aqueous dispersions of PEDOT:PSS are commercially available as BAYTRON P® from H. C. Starck, Inc. (Boston, Mass.). PEDOT:PSS films coated on Mylar are commercially available in Orgacon™ films (Agfa-Gevaert Group, Mortsel, Belgium). PEDOT may also be obtained through chemical polymerization, for example, by using electrochemical oxidation of electron-rich EDOT-based monomers from aqueous or non-aqueous medium. Exemplary chemical polymerization of PEDOT can include those disclosed by Li Niu et al., entitled "Electrochemically Controlled Surface Morphology and Crystallinity in Poly(3,4-ethylenedioxythiophene) Films," Synthetic Metals, 2001, Vol. 122, 425-429; and by Mark Lefebvre et al., entitled "Chemical Synthesis, Characterization, and Electrochemical Studies of Poly(3,4-ethylenedioxythiophene)/Poly(styrene-4-sulfonate) Composites," Chemistry of Materials, 1999, Vol. 11, 262-268, which are hereby incorporated by reference in their entirety. As also discussed in the above references, the electrochemical synthesis of PEDOT can use a small amount of monomer, and a short polymerization time, and can yield electrode-supported and/or freestanding films.

The array of pixels 425 can be formed by first depositing the patternable material as a layer upon the substrate 410. Any suitable method can be used to form this layer, for example by using dip coating, spray coating, spin coating, web coating, draw down coating, flow coating, and/or extrusion die coating. The patternable material can then be patterned or otherwise treated to form an array of pixels 425. Suitable nanofabrication techniques that can be used to create the array of pixels 425 include photolithographic etching, nano-imprinting, inkjet printing, and/or screen printing. As a result, each pixel 425 of the array 420 can have at least one dimension (length or width) ranging from about 100 nm to about 500 μm, or from about 1 μm to about 250 μm, or from about 5 μm to about 150 μm. In some embodiments, the pixels have dimensions in the range of tens of microns, i.e. from about 10 μm to about 100 μm.

The charge transport layer 416 is configured to transport holes provided by the one or more pixels 425 to the surface 417 opposite the array of pixels 425. The charge transport layer 414 can include materials capable of transporting either holes or electrons through the charge transport layer to selectively dissipate a surface charge. In certain embodiments, the charge transport layer 416 comprises a charge-transporting small molecule dissolved or molecularly dispersed in an electrically inert binder polymer. In embodiments, the charge-transporting small molecule can be dissolved in the electrically inert polymer to form a homogeneous phase with the polymer.

Any suitable charge transport molecule can be employed in the charge transport layer 416. Exemplary charge-transporting small molecules include pyrazolines such as 1-phenyl-3-(4'-diethylaminostyryl)-5-(4"-diethylamino phenyl)pyrazoline; diamines such as N,N'-diphenyl-N,N'-bis(3-methylphenyl)-(1,1'-biphenyl)-4.4'-diamine (TPD): other arylamines like triphenylamine or N,N,N',N'-tetra-p-tolyl-1,1'-biphenyl-4,4'-diamine (TM-TPD); hydrazones such as N-phenyl-N-methyl-3-(9-ethyl)carbazyl hydrazone and 4-diethylaminobenzaldehyde-1,2-diphenyl hydrazone; oxadiazoles such as 2,5-bis(4-N,N'-diethylaminophenyl)-1,2,4-oxadiazole; stilbenes; and the like. Exemplary arylamines can have the following structures (B) or (C):

Structure (B)

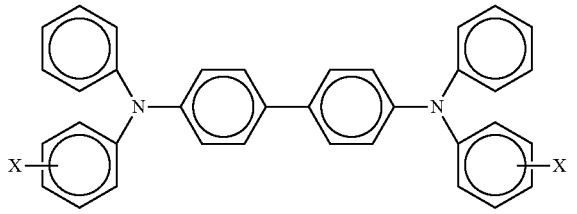

Structure (C)

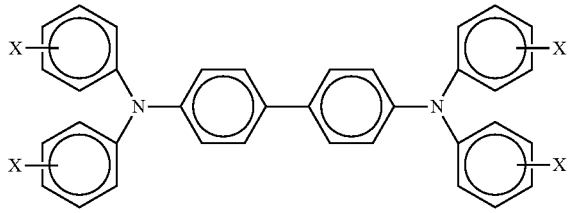

wherein each X is independently a suitable hydrocarbon like alkyl, alkoxy, aryl, and derivatives thereof; a halogen, or mixtures thereof, and especially those substituents selected from the group consisting of Cl and $CH_3$. Other suitable charge transport molecules are of Structures (D) or (E):

Structure (D)

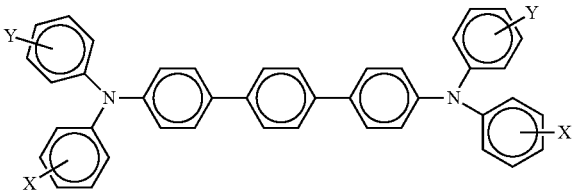

Structure (E)

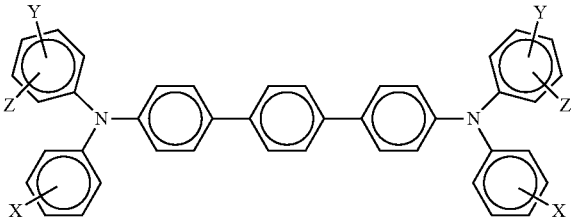

wherein X, Y and Z are independently alkyl, alkoxy, aryl, a halogen, or mixtures thereof.

The term "alkyl" refers to a radical composed entirely of carbon atoms and hydrogen atoms which is fully saturated and of the formula $—C_nH_{2n+1}$. The alkyl radical may be linear, branched, or cyclic.

The term "alkoxy" refers to an alkyl radical which is attached to an oxygen atom, i.e. $—O—C_nH_{2n+1}$.

The term "aryl" refers to an aromatic radical composed entirely of carbon atoms and hydrogen atoms. When aryl is described in connection with a numerical range of carbon atoms, it should not be construed as including substituted aromatic radicals. For example, the phrase "aryl containing from 6 to 10 carbon atoms" should be construed as referring to a phenyl group (6 carbon atoms) or a naphthyl group (10 carbon atoms) only, and should not be construed as including a methylphenyl group (7 carbon atoms).

Generally, the alkyl and alkoxy groups each independently contain from 1 to 30 carbon atoms, including from 1 to about 18 carbon atoms. Similarly, the aryl groups independently contain from 6 to 36 carbon atoms. Substituted groups are also contemplated, wherein at least one hydrogen atom on the named radical is substituted with another functional group, such as halogen, —CN, $—NO_2$, —COOH, and $—SO_3H$. An exemplary substituted alkyl group is a perhaloalkyl group, wherein one or more hydrogen atoms in an alkyl group are replaced with halogen atoms, such as fluorine, chlorine, iodine, and bromine. Besides the aforementioned functional groups, an aryl group may also be substituted with alkyl or alkoxy. Exemplary substituted aryl groups include methylphenyl and methoxyphenyl.

Specific arylamines that can be used in the charge transport layer 316 include N,N'-diphenyl-N,N'-bis(alkylphenyl)-1,1'-biphenyl-4,4'-diamine wherein alkyl contains 1 to 18 carbon atoms; N,N'-diphenyl-N,N'-bis(chlorophenyl)-1,1'-biphenyl-4,4'-diamine; N,N'-bis(4-butylphenyl)-N,N'-di-p-tolyl-[p-terphenyl]-4,4"-diamine; N,N'-bis(4-butylphenyl)-N,N'-di-m-tolyl-[p-terphenyl]-4,4"-diamine; N,N'-bis(4-butylphenyl)-N,N'-di-o-tolyl-[p-terphenyl]-4,4"-diamine; N,N'-bis(4-butylphenyl)-N,N'-bis-(4-isopropylphenyl)-[p-terphenyl]-4,4"diamine; N,N'-bis(4-butylphenyl)-N,N'-bis-(2-ethyl-6-methylphenyl)-(p-terpheny1]-4,4"diamine; N,N'-bis(4-butylphenyl)-N,N'.bis-(2,5-dimethylphenyl)-[p-terphenyl]-4,4'-diamine; N,N'-diphenyl-N,N'-bis(3-chlorophenyl)-[p-terphenyl]-4,4"-diamine; and the like.

Any suitable electrically inert binder polymer can be employed in the charge transport layer 416. Typical electrically inert binder polymers used in conjunction with the charge transport molecule can include polycarbonates, polyarylates, polystyrenes, acrylate polymers, vinyl polymers, cellulose polymers, polyesters, polysiloxanes, polyimides, polyurethanes, polycycloolefins, polysulfones, epoxies, and random or alternating copolymers thereof.

In embodiments, the charge transport layer may comprise from about 25 weight percent to about 60 weight percent of the charge transport molecule and from about 40 weight percent to about 75 weight percent by weight of the electrically inert polymer, both by total weight of the charge transport layer. In specific embodiments, the charge transport layer comprises from about 40 weight percent to about 50 weight percent of the charge transport molecule and from about 50 weight percent to about 60 weight percent of the electrically inert polymer.

Alternatively, the charge transport layer can be formed from a charge transport polymer. Any suitable polymeric charge transport polymer can be used, such as poly(N-vinylcarbazole); poly(vinylpyrene); poly(vinyltetraphene); poly(vinyltetracene), and/or poly(vinylperylene).

Optionally, the charge transport layer can include materials to improve lateral charge migration (LCM) resistance such as hindered phenolic antioxidants like, for example, tetrakis methylene(3,5-di-tert-butyl-4-hydroxy hydrocinnamate) methane (IRGANOX® 1010, available from Ciba Specialty Chemical, Tarrytown, N.Y.), butylated hydroxytoluene (BHT), and other hindered phenolic antioxidants including SUMILIZER™ BHT-R, MOP-S, BBM-S, WX-R, NW, BP-76, BP-101, GA-80, GM, and GS (available from Sumitomo Chemical America, Inc., New York, N.Y.), IRGANOX® 1035, 1076, 1098, 1135, 1141, 1222, 1330, 1425WL, 1520L, 245, 259, 3114, 3790, 5057, and 565 (available from Ciba Specialties Chemicals, Tarrytown, N.Y.), and ADEKA STAB™ AO-20, AO-30, AO-40, AO-50, AO-60, AO-70, AO-80, and AO-330 (available from Asahi Oenka Co., Ltd.); hindered amine antioxidants such as SANOL™ LS-2626, LS-765, LS-770, and LS; 744 (available from SANKYO CO., Ltd.), TINUVIN® 144 and 622LD (available from Ciba Specialties Chemicals, Tarrytown, N.Y.). MARK™ LA57, LA67. LA62, LA68, and LA63 (available from Amfine Chemical Corporation, Upper Saddle River, N.J.), and SUMILIZER® TPS (available from Sumitomo Chemical America, Inc., New York, N.Y.); thioether antioxidants such as SUMILIZER® TP-D (available from Sumitomo Chemical America, Inc., New York, N.Y.); phosphite antioxidants such as MARK™ 2112, PEP-B, PEP-24G, PEP-36, 329K, and HP-10 (available from Amfine Chemical Corporation, Upper Saddle River, N.J.); other molecules such as bis(4-diethylamino-2-methylphenyl) phenylmethane (BDETPM), bis-[2-methyl-4-(N-2-hydroxyethyl-N-ethyl-aminophenyl)]-phenylmethane (DHTPM), and the like. The charge transport layer can contain antioxidant in an amount ranging from about 0 to about 20 weight %, from about 1 to about 10 weight %, or from about 3 to about 8 weight % based on the total charge transport layer.

The charge transport layer may be considered an insulator to the extent that the electrostatic charge placed on the charge transport layer is not conducted such that formation and retention of an electrostatic latent image thereon can be prevented. On the other hand, the charge transport layer can be considered electrically "active" in that it allows the injection of holes from the hole injecting layer to be transported through the charge transport layer itself to enable selective discharge of a negative surface charge on the imaging member surface 417.

Any suitable and conventional techniques can be utilized to form the charge transport layer. A single coating step or multiple coating steps can be used. Application techniques can include spraying, dip coating, roll coating, wire wound rod coating, ink jet coating, ring coating, gravure, drum coating, and the like. Drying of the deposited coating can be effected by any suitable conventional technique such as oven drying, infra red radiation drying, air drying and the like. After drying, the charge transport layer can have a thickness in the range of about 1 μm to about 50 μm, about 5 μm to about 45 μm, or about 15 μm to about 40 μm, but may be as thick as 100 micrometers.

The substrate provides support for all layers of the imaging member. Its thickness depends on numerous factors, including mechanical strength, flexibility, and economical considerations, and may be for example from about 50 micrometers to about 150 micrometers thick, provided there are no adverse effects on the final imaging member. The substrate is desirably not soluble in any of the solvents used to form the other layers of the imaging member, is optically transparent, and is desirably thermally stable up to a high temperature of about 150° C. Suitable materials that can be used for the substrate 410 include, but are not limited to, mylar, polyimide (PI), flexible stainless steel, poly(ethylene napthalate) (PEN), and flexible glass.

The optional adhesion layer 418 can be made from, for example, polyester resins like polyarylatepolyvinylbutyrals, such as U-100 available from Unitika Ltd., Osaka, J P; VITEL PE-100, VITEL PE-200, VITEL PE-200D, and VI TEL PE-222, all available from Bostik, Wauwatosa, Wis.; MOR•ESTER™ 49000-P polyester available from Rohrn Hass, Philadelphia, Pa.; polyvinyl butyral; and the like.

The protective overcoat layer 419 may be use to protect the surface of the charge transport layer as well as improve the ease of cleaning the imaging member of ink. Such overcoat layers are known in the art.

Any suitable flexo ink can be used including, such as, for example, solvent based flexo ink, UV flexo ink, or water based flexo ink. Exemplary flexo ink can include, but are not limited to, UVivid 820 Series UV Flexo ink, UVivid 850 Series UV Flexo ink, and UVivid 800 Series UV Flexo ink, all manufactured by FUJIFILM North America Corporation, Kansas City, Kans.; water based flexo inks from BCM inks USA, flexo packaging ink from Dun Chemicals, NWUV-16-846 and NWUV-16-848/849 UV flexo inks, and NWS2-10-931 water based flexo ink, manufactured by Atlantic Printing Ink, Ltd., Tampa, Fla.

Referring back to FIG. 3, the flexographic printing system 300 includes a development subsystem 330 located relative to the nano-enabled imaging member 310, such that the development subsystem 330 and the nano-enabled imaging member 310 form a development nip 305. The electrostatic latent image on the surface 314 of the imaging member can be developed here.

In the digital flexographic printing system 300, the pixels of the nano-enabled imaging member 310 that are charged by hole injection attract ink in an electrophoretic or electrohydrodynamic like process, thus forming the developed latent image that can be transferred to a substrate. The function of the development subsystem 330 is to deliver ink to the electrostatic latent image on the surface 314 of the nano-enabled imaging member 310. The developing material selectively adheres to the charged areas to form a developed image 340 on the nano-enabled imaging member 310. The electrostatic latent image is developed at the development nip 305 using any suitable developing material to form a developed image 340. Exemplary developing materials can include, but are not limited to, liquid toner, hydrocarbon based liquid ink, and/or flexographic/offset ink. The term "ink" may be used herein to refer to all developing materials. Development occurs due to an electrostatic image charge created on the ink by the charged areas of the electrostatic latent image surface on the nano-enabled imaging member 310.

Referring now to FIG. 2, the anilox roll 232 provides a measured amount of ink to the imaging member 210. Again, an anilox roll has an outer surface comprising a large number of cells that deliver a metered amount of ink. The selective charging of the imaging member controls the transfer of ink from the anilox roll to the imaging member. However, anilox rolls increase the cost of the system.

In conventional flexography that used a raised relief plate, the use of an anilox roll was needed to ensure that only raised portions of the relief plate were inked and the depressed portions of the relief plate were not inked. The transfer of ink from the anilox roll to the imaging member is due to a combination of pressure, ink viscosity, capillary forces, and nip contact speed. The cells of the anilox roll were used to optimize ink leveling and deliver a uniform amount of ink per unit area. However, with the use of a nano-enabled imaging member, that function is not necessary. The amount and location of ink transferred to the imaging member can now be controlled by the area of the pixel on the imaging member and the electrical field used. Put another way, the pixels now meter the amount of ink transferred, similar to the function of the cells in the anilox roll, so an anilox roll is not needed. Thus, referring now to FIG. 3, a simple rough donor roll 332 can be used instead that simply supplies ink to the imaging member, and there is no concern about inking an area that is not supposed to be inked.

Referring to the donor roll, the term "rough" refers to the fact that the surface of the donor roll is not patterned. The rough ink donor roll 332 may comprise a metal, such as aluminum, or be made from a ceramic. The ink donor roll 332 is not an anilox roll. Please note that the development nip 305 includes a gap 307 between the donor roll 332 and the imaging member surface 314. This gap typically has a distance of from about 1 μm to about 50 μm wide. The surface roughness of the donor roll 332 is less than this gap. In embodiments, the ink donor roll 332 may have a surface roughness of from about 0.1 μm to about 50 μm. In more specific embodiments, the ink donor roll 332 may have a surface roughness of from 0.25 μm to 2 μm.

The ink is electrophoretically attracted to the charged areas of the nano-enabled imaging member 310, but not to the discharged areas, thereby developing the latent image.

In the digital flexographic printing system of the present disclosure, the sign and direction of the electric field is generally not relevant here, but can be either direct current (DC) or alternating current (AC), and may have a high frequency of greater than 1 kHz. The electric field generated by the imaging member relative to the grounded donor roll 332 may have a strength in the range of 10 V/μm to 100 V/μm.

Referring back to FIG. 3, the digital flexographic printing system 300 can also include a transfer subsystem 315 for transferring the developed image onto a receiving medium 316, such as paper. During transferring, the receiving medium 316 can come in substantially close contact with the developed image 340 on the surface 314 of the nano-enabled imaging member 310.

For monochrome printers, the nano-enabled imaging member 310 can transfer the developed image 340 directly to the receiving medium 316. For color printers, generally a developed image is formed for each color (e.g. CMYK) and built up an image directly to the paper or to an intermediate transfer member (not shown). Once all of the colors are developed, the final developed image made up of all the colors is transferred to the receiving medium. In some embodiments, it is contemplated that the digital flexographic printing system 300 can include four nano-enabled imaging members, one for each color. For example, the color printer can use a different sequence of events where each colored developed image is transferred to the receiving medium in sequence.

The digital flexographic printing system 300 can also include a fixing subsystem 320 to fix the developed image onto the receiving medium. In the fixing process, the ink can be permanently fixed to the substrate either by heat, pressure, UV cure, or some combination thereof. In some embodiments, the digital flexographic printing system 300 can use a transfix system that transfers and fixes the developed image onto the receiving medium 316 in one step instead of a separate transfer subsystem and fixing subsystem.

The digital flexographic printing system 300 generally further includes a cleaning subsystem 317. The transfer of ink from the nano-enabled imaging member to the receiving medium may not be 100% efficient in some cases. This is because small ink drops can adhere strongly to the nanoenabled imaging member and resist transfer. This residual ink must be removed from the nano-enabled imaging member before the next print cycle, or they can affect the printing quality of the next image. The cleaning subsystem may include a compliant cleaning blade that rubs against the nanoenabled imaging member and scrapes off any remaining ink. The cleaning subsystem may include a rotating brush cleaner, which can be more efficient at removing ink and is less abrasive to the surface of the nano-enabled imaging member.

The following examples are for purposes of further illustrating the present disclosure. The examples are merely illustrative and are not intended to limit devices made in accordance with the disclosure to the materials, conditions, or process parameters set forth therein.

EXAMPLES

Example 1

Printing Test Using a Patterned Bi-Layer Imaging Member

A PEDOT layer was patterned on a Mylar substrate by inkjet printing using a Dimatix inkjet printer model DMP2800 (FUJIFILM Dimatix, Inc., Santa Clara, Calif.). The PEDOT layer served as a hole injecting layer. A charge transport layer (CTL) of about 18 μm thick containing N,N'-diphenyl-N,N-bis(3-methyl phenyl)-1,1'-biphenyl-4,4'-diamine (TPD) and PCZ200 (a polycarbonate) in a weight ratio of 3:1 was coated over the patterned PEDOT layer to form a patterned PEDOT bi-layer imaging member. The imaging member was then pasted on a photoreceptor drum and was grounded.

Figure 5:
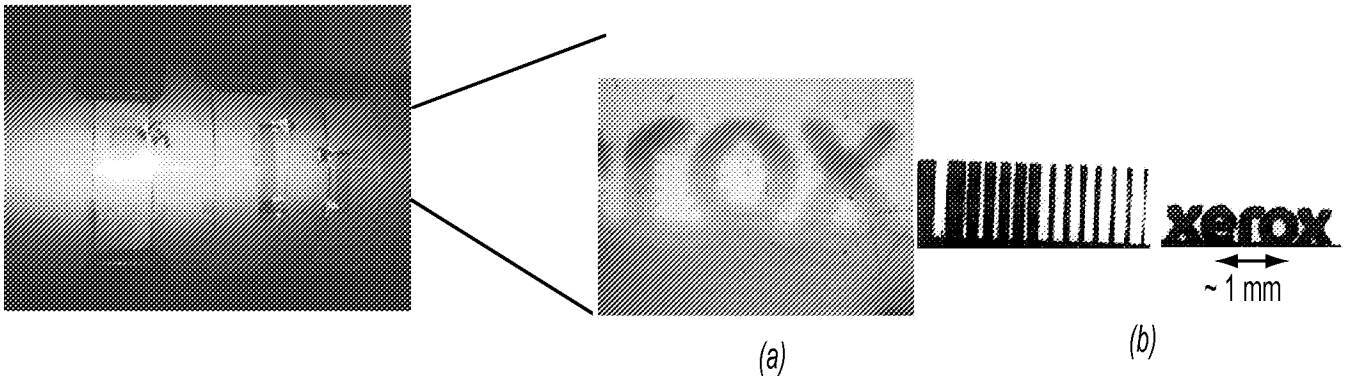
FIG. 5 is the print test result of a patterned PEDOT bilayer imaging member using xerographic toner.

A print test was then conducted using this bi-layer imaging member. The results are seen in FIG. 5. The print test results demonstrated that PEDOT was easily patterned onto a substrate and that good prints could be obtained using PEDOT for the hole injecting layer. These patterned PEDOT pixels, when coupled to a TFT matrix, will behave as a digital printing device.

In a second device, a carbon nanotube layer was used instead of the PEDOT layer. Print test results demonstrated that carbon nanotubes could be easily patterned onto a substrate and that good prints could be obtained.

Example 2

Direct Digital Printing

A 15 cm×15 cm piece of a PEDOT/TPD bi-layer imaging member (as described in Example 1) was pasted on an organic photoconductor (OPC) drum. The surface resistivity of the PEDOT layer was about 350 Ω/sq. The bilayer member was attached on the OPC drum by kapton tape. The OPC drum was used to provide a support for the bilayer member and to provide a patch for the bilayer member to be electrically grounded. The bilayer member on the OPC drum was electrically grounded to the aluminum groundplane of the OPC drum by silver paste. Printing experiments were performed by mounting this OPC drum onto a bench DC8000 development fixture. The OPC drum was allowed to rotate at a speed of about 352 mm/s under a negatively biased, toned semiconducting magnetic brush (SCMB). Ultra-low melt EA Cyan toner was used for the printing experiment.

Experimental results (not illustrated) show that after passing through the development nip, toner development was obtained on the bilayer member. Toner image was formed on the PEDOT nano-enabled imaging member by just passing the development nip.

Figure 6:
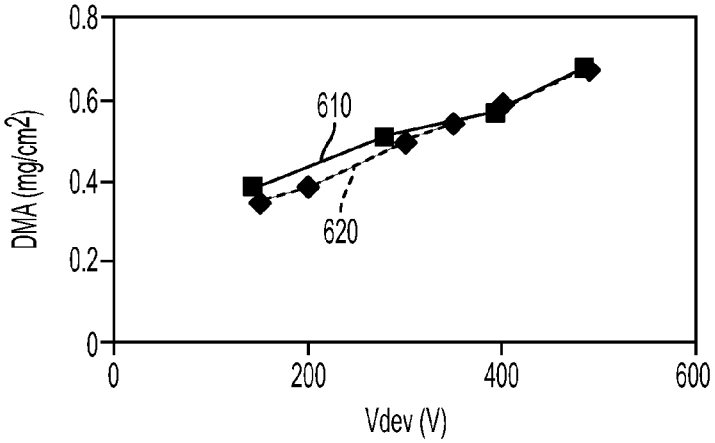
FIG. 6 compares the development mass area (DMA) of direct printing measured with and without the charging of the nanoenabled imaging member.

FIG. 6 is a graph showing the development mass per unit area obtained at a given development bias (Vdev) under two different printing conditions. Curve 620 was obtained under the condition described above. Curve 610 was obtained under a slightly different condition where a scorotron charger was used to discharge the nanoimaging member prior to the development nip.

The similarity in development in both configurations of FIG. 6 indicates that the magnetic brush served a dual role in the direct printing mode. If the magnetic brush did not play a dual role, then there would have been no hole-induced injection reaction, resulting in no development. As the bilayer first contacted the magnetic brush, the bias on the magnetic brush induced a hole injection reaction to create the electrostatic latent image on the CTL surface of the bilayer. This was followed by toner development before the bilayer member exited the development nip. This two step process was accomplished within the development nip, resulting in direct toner printing.

The observed direct printing processes can simplify the generation of electrostatic images as compared to xerography and can be extended to liquid inks and flexo inks depending on the imaging material. Furthermore, the above described direct printing process can be digitized by coupling the printing process with a TFT backplane, for example.

Example 3

Concept Printing with Flexo Ink

Figure 7:
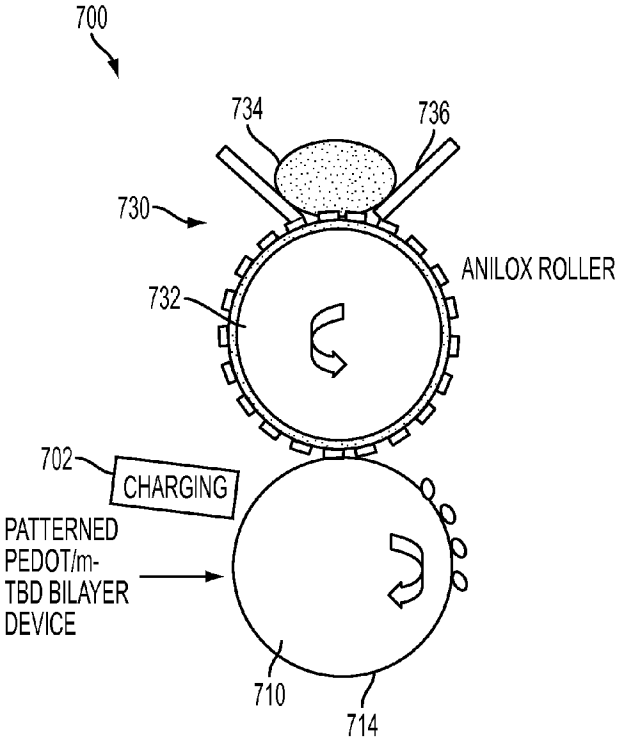
FIG. 7 is a schematic diagram showing the layout of a printing system used in the Example.

As proof of concept, a nano-enabled imaging member 700 was used in a system illustrated in FIG. 7. An imaging drum 710 was covered with a patterned bilayer device 714 having a PEDOT:PSS layer and a CTL. The bilayer device was grounded. The development subsystem 730 used an anilox roll 732 that was metered by a doctor blade 736. Cyan flexographic ink 734 was used. A wire scorotron 702 was used to provide an electric field on the bilayer device.

Figure 8:
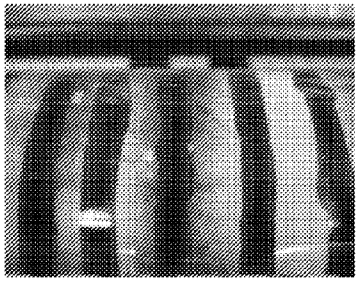
FIG. 8 is a picture showing the direct printing result of the printing system of FIG. 7 with charging.

FIG. 8 shows the printing result. Specifically, the flexographic ink printed selectively.

Figure 9:
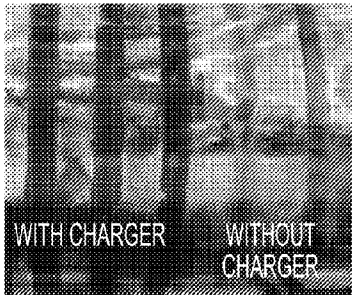
FIG. 9 is a picture showing the direct printing result when the charger of the printing system of FIG. 7 is partially covered.

Next, to show that an electric field was required, the scorotron was partially covered with an insulating polyimide tape. FIG. 9 shows the printing result. The flexo ink only printed in the area where the bilayer device was exposed to the scorotron charger, further proving the concept that an electric field is needed for selectively printing the flexo ink with a nano-enabled imaging member.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

The invention claimed is:

1. A flexographic printing system comprising:
- a nano-enabled imaging member comprising:
  - an array of hole-injecting pixels, each pixel being electrically isolated and individually addressable; and
  - a charge transport layer disposed over the array of hole-injecting pixels;
- a development subsystem comprising:
  - a rough ink donor roll having a surface roughness;
  - an ink supply; and
  - a doctor blade for metering ink; and
- an ultra-violet curing source located downstream of the development subsystem for partial curing of a developed image on the imaging member;
- wherein a gap between the nano-enabled imaging member and the rough ink donor roll has a distance of from about 1 μm to 50 μm; and
- wherein the surface roughness of the rough ink donor roll is less than the gap between the nano-enabled imaging member and the rough ink donor roll.

2. The flexographic printing system of claim 1, wherein the nano-enabled imaging member further comprises an array of thin film transistors between a substrate and the array of hole-injecting pixels, wherein each thin film transistor is connected to one pixel of the array of hole-injecting pixels.

3. The flexographic printing system of claim 1, wherein each pixel comprises a nano-carbon material.

4. The flexographic printing system of claim 3, wherein the nano-carbon material comprises a single-wall carbon nanotube, a double-wall carbon nanotube, a multi-wall carbon nanotube, graphene, or a mixture of carbon nanotubes and graphene.

5. The flexographic printing system of claim 1, wherein each pixel comprises a conjugated polymer.

6. The flexographic printing system of claim 5, wherein the conjugated polymer is PEDOT:PSS.

7. The flexographic printing system of claim 5, wherein the conjugated polymer is selected from the group consisting of poly(3,4-ethylenedioxythiophene) (PEDOT), alkyl substituted ethylenedioxythiophene, phenyl substituted ethylenedioxythiophene, dimethyl substituted polypropylenedioxythiophene, cyanobiphenyl substituted 3,4-ethylenedioxythiopene, teradecyl substituted PEDOT, dibenzyl substituted PEDOT, an ionic group substituted PEDOT, a dendron substituted PEDOT, and mixtures thereof.

8. The flexographic printing system of claim 1, wherein the charge transport layer comprises a charge transport molecule dispersed in a binder polymer.

9. The flexographic printing system of claim 8, wherein the charge transport molecule is a pyrazoline, diamine, arylamine, hydrazone, oxadiazole, or stilbene.

10. The flexographic printing system of claim 8, wherein the binder polymer is a polycarbonate, polyarylate, polystyrene, acrylate polymer, vinyl polymer, cellulose polymer, polyester, polysiloxane, polyimide, polyurethane, polycycloolefin, polysulfone, or epoxy.

11. The flexographic printing system of claim 1, wherein the charge transport layer comprises N,N'-diphenyl-N,N'-bis(3-methylphenyl)-(1,1'-biphenyl)-4.4'-diamine.

12. The flexographic printing system of claim 1, wherein the charge transport layer is overcoated with an ink resistant protective layer.

13. The flexographic printing system of claim 12, wherein the thickness of the protective layer is from about 0.5 μm to about 5 μm.

14. The flexographic printing system of claim 1, wherein the thickness of the charge transport layer is from about 1 μm to about 30 μm.

15. The flexographic printing system of claim 1, wherein the rough ink donor roll has a surface roughness of from about 0.1 μm to about 50 μm.

16. The flexographic printing system of claim 1, wherein the rough ink donor roll is made of aluminum, steel, ceramic, or a plastic material.

17. A flexographic printing system comprising:
- a nano-enabled imaging member comprising:
  - a substrate;
  - an array of hole-injecting pixels, each pixel being electrically isolated and individually addressable, and each pixel being formed from a nano-carbon material or a conjugated polymer; and
  - a charge transport layer disposed over the array of hole-injecting pixels;
- a development subsystem comprising:
  - a rough ink donor roll having a surface roughness;
  - an ink supply; and
  - a doctor blade for metering ink; and
- an ultra-violet curing source located downstream of the development subsystem for partial curing of a developed image on the imaging member;

wherein a gap between the nano-enabled imaging member and the rough ink donor roll is about 1 μm to 50 μm wide; and wherein the surface roughness of the rough ink donor roll is less than the gap between the nano-enabled imaging member and the rough ink donor roll.

18. The flexographic printing system of claim 17, wherein the ink rough donor roll has a surface roughness of from about 0.1 μm to about 50 μm.

* * * * *